US007511626B2

(12) United States Patent
Siegmann et al.

(10) Patent No.: US 7,511,626 B2
(45) Date of Patent: Mar. 31, 2009

(54) RESIDENTIAL ELEVATOR WITH AUTOMATIC PET DOOR FOR DETECTION AND LOGIC COMPONENT FOR OPERATION

(76) Inventors: Susan M. Siegmann, 3077 Steig Rd., North Tonawanda, NY (US) 14120; Andrew Darnley, III, 4132 Alto Sierra Way, El Dorado Hills, CA (US) 95762; Jeffrey P. Zehler, 3017 Aberdeen La., El Dorado Hills, CA (US) 95762

( * ) Notice: Subject to any disclaimer, the term of this patent is extended or adjusted under 35 U.S.C. 154(b) by 214 days.

(21) Appl. No.: 11/464,802

(22) Filed: Aug. 15, 2006

(65) Prior Publication Data

US 2008/0041665 A1 Feb. 21, 2008

(51) Int. Cl.
*G08B 23/00* (2006.01)

(52) U.S. Cl. ..... 340/573.3; 119/484; 119/843.15; 187/247; 187/391

(58) Field of Classification Search ..... 340/573.3; 160/180; 49/167–170, 25, 360–374; 119/484, 119/29, 843, 15; 187/247, 277, 391
See application file for complete search history.

(56) References Cited

U.S. PATENT DOCUMENTS 4,027,626 A * 6/1977 DeSousa ..... 119/475
4,165,714 A * 8/1979 Weissman et al. ..... 119/674
4,261,440 A * 4/1981 Jacoby ..... 187/317
6,966,147 B2 * 11/2005 Solowiej ..... 49/169
2002/0183008 A1 * 12/2002 Menard et al. ..... 455/66
2004/0194734 A1 * 10/2004 Fisher ..... 119/843
2005/0161000 A1 * 7/2005 Noyes ..... 119/484
2005/0252622 A1 * 11/2005 Reid ..... 160/180

* cited by examiner

*Primary Examiner*—Brent Swarthout
(74) *Attorney, Agent, or Firm*—White-Welker & Welker, LLC

(57) ABSTRACT

The present invention combines a residential elevator and automatic pet door with an intelligence component comprised of a Programmable Logic Controller with programmed intelligence that enables interoperability between the residential elevator and automatic pet door. In practice a pet will wear a collar with an attached or embedded transmitter. As the pet approaches the elevator door, the swing door will open and the accordion gate will open. If the elevator is at another level when the pet approaches, a call will be submitted to bring the elevator to the pet's level. The swing door and gate will open automatically when the elevator arrives. The gate and door will remain open long enough for the pet to enter the elevator and close automatically. The call to another floor will automatically be submitted to the elevator based on the current floor location.

17 Claims, 2 Drawing Sheets

RESIDENTIAL ELEVATOR WITH AUTOMATIC PET DOOR FOR DETECTION AND LOGIC COMPONENT FOR OPERATION

FEDERALLY SPONSORED RESEARCH

Not Applicable

SEQUENCE LISTING OR PROGRAM

Not Applicable

CROSS REFERENCE TO RELATED APPLICATIONS

Not Applicable

TECHNICAL FIELD OF THE INVENTION

The present invention relates generally to residential elevators. More specifically, the present invention relates to residential elevators and pet doors consisting of automated and logic means for movement, loading, and unloading.

BACKGROUND OF THE INVENTION

The present invention is a novel and non-obvious combination of two commercially available products known in prior art, a Residential Elevator and an Automatic Pet Door.

Residential Elevators are well known in the prior art and operate similar to commercial elevators with the exception of door/gate. A commercial elevator has automatic side sliding door at each level, and an automatic side-sliding gate on the cab. A residential elevator has swing doors at each level and a collapsing accordion gate on the cab. Upgrades are available for residential elevators to provide automatic opening of the swing doors and the accordion gate. The opening of the door and gate is initiated by pressing the hall call button or pressing a button on a remote control. The user enters the cab and press a button on the wall indicating the floor they wish to travel to.

Automatic Pet Doors are also known in the prior art and look like a typical pet door, but have a high tech upgrade. The pet wears a collar with a transmitter. The door has a receiver in it that senses when the pet approaches. As the pet approaches the door, the door is opened automatically by a motorized mechanism within the door assembly.

Several devices combining automatic doors, detection means, and other residential appliances, furniture, and equipment are known and taught in the prior art. One example is U.S. patent application Ser. No. 20020158764 entitled "Pet cage assembly having smoke activated escape feature" published on Oct. 31, 2002 to Conway which teaches a system and method for freeing a pet from a portable holding cage. A portable holding cage is provided with a door that can be locked in a closed position by an electromechanical locking mechanism. The operation of the electromechanical locking mechanism is controlled by a systems controller. The systems controller monitors alarm signals transmitted to it from a remote smoke detector. The transmitted alarm signals can be audible alarm signals, radio alarm signals or optical alarm signals. Once the alarm signal is received and identified by the systems controller, the systems controller activates the electromechanical locking mechanism and opens the door to the holding cage.

U.S. patent application Ser. No. 20050274463 entitled "Pet door and method of operation" published on Dec. 15, 2005 to Becker teaches a pet door system including a door, a detection device, a receiver, a motor and a controller. The detection device detects the proximate presence of a pet to the door. The receiver receives an identification signal that establishes an identity of the pet. The motor is operatively connected to the door. The controller is communicatively coupled to the detection device, to the receiver and to the motor. The controller issues a signal to the motor to open the door based upon the identity of the pet.

U.S. patent application Ser. No. 20050252622 entitled "Automatic pet door" published on Nov. 17, 2005 to Reid teaches a pet door comprising a flap defining a pet access opening, a door flap pivotally mounted in the opening about a pivot axis located at an upper edge of the door flap, a latch mechanism to bar the door flap from opening in at least one direction, and a control mechanism for disabling the latch mechanism to permit the door flap to open in the said at least one direction, the control mechanism including an infrared radiation detector which is mounted above a lower edge of the pet access opening and defines a downwardly directed receiving zone for infrared radiation.

U.S. patent application Ser. No. 20050198901 entitled "Automatic pet door" published on Sep. 15, 2005 to Solowiej teaches an automatic pet door system that has a rectangular frame mounted between studs of a wall defining a passage for entry and exit of a pet. A door slidably moves within the frame between a lower closed position for closing the passage and an upper open position for opening the passage.

U.S. Pat. No. 6,966,147 entitled "Automatic pet door" issued to Powell, et al on Nov. 22, 2005 teaches an automatic pet door system that has a rectangular frame mounted between studs of a wall defining a passage for entry and exit of a pet. A door slidably moves within the frame between a lower closed position for closing the passage and an upper open position for opening the passage.

U.S. Patent Application 20050161000 entitled "Window mounted pet door" published on Jul. 28, 2005 to Noyes teaches a window mounted pet door device. The device is intended to solve problems inherent in the prior art by providing for installation and use of the device in a window, including upper floor windows, without significantly modifying the window unit, thereby increasing the availability of suitable installation locations and appealing to pet owners who do not wish to structurally modify their homes. It also provides a pet access platform component to give a pet a convenient structure for approaching the device when it is installed above ground or floor level. The device may include an automatic door access component and a pet-specific identification component whereby only authorized animals are permitted to access the pet door.

U.S. Pat. No. 6,710,714 entitled "Pet cage assembly having smoke activated escape feature" issued to Conway on Mar. 23, 2004 teaches a system and method for freeing a pet from a portable holding cage. A portable holding cage is provided with a door that can be locked in a closed position by an electromechanical locking mechanism. The operation of the electromechanical locking mechanism is controlled by a systems controller. The systems controller monitors alarm signals transmitted to it from a remote smoke detector. The transmitted alarm signals can be audible alarm signals, radio alarm signals or optical alarm signals. Once the alarm signal is received and identified by the systems controller, the systems controller activates the electromechanical locking mechanism and opens the door to the holding cage.

U.S. Patent Application 20030204996 entitled "Remotely controlled pet door" published on Nov. 6, 2003 to Gillett teaches a pet door unit for mounting in a structure, is described. The unit includes a housing, an opening mechanism, a door, a receiver and a transmitter. The door is mounted parallel to the rear wall of the housing in guide rails extending along the sidewalls of the housing. The opening mechanism includes a motor having a screw drive and a carriage that is movably mounted on the screw drive. The carriage is connected to the top of the pet door and moves along the length of the screw shaft as the shaft rotates to open and close the door. To open the door, a user presses a button on the portable transmitter that sends a signal to the receiver. When the receiver receives the signal, it activates the opening mechanism that activates the motor to rotate the screw drive to move the carriage and the door up the shaft to the open position.

U.S. Pat. No. 5,095,852 entitled "Elevator/staircase toy for small animals" issued to Hoover on Mar. 17, 1992 teaches an elevator/staircase toy for small animals (hamsters, gerbils, mice, or other small animals) housed in a transparent containment structure and comprising, first, a plurality of vertical walls radiating from a central vertical axis with a rotational sequence of horizontal plates disposed between them and offset vertically in an incremental and progressive manner, with a plurality of apertures disposed in the vertical walls in corresponding relation to the plates, optionally including one-way passage means on the apertures, and providing maximum floor space due to plate offsets and vertical apertures, secure, segmented living space which easily accommodates bedding, mazelike complexity in a compact structure offering directly viewable compartments and positive routing from a first horizontal plate to a designated last horizontal plate accessing an elevator, and second, an animal-operated and automatically resetting elevator embodied in a pair of counterbalanced elevator cars connected by cable suspended over guide pulleys and possessing cushioning means and animal-controlled or weight-sensitive retaining means. There are numerous safety features and food can be dropped directly into each elevator car for motivation. A bell is optional. Elevators lift out with a lid and the staircase disassembles with interlocking surfaces.

U.S. Pat. No. 5,952,926 entitled "Pet doorbell apparatus" issued to Hoover on Sep. 14, 1999 teaches a pet doorbell apparatus for providing a doorbell system for pets to use to notify home occupants of their desire to enter or exit the house. The inventive device includes cover cap activator attached to the outside or inside of a home. The cover cap activator includes a base plate and an enclosing cover pivotally mounted to the base plate. The enclosing cover is movable from a first position to a second position when the enclosing cover is depressed by a pet desiring to enter a home. When the enclosing cover is depressed, a transmitter mounted to the base plate is activated by an activator extending from the enclosing cover. The transmitter sends a signal to a receiver so that speaker included in the receiver produces a sound to alert a person within the home to let the pet inside.

One shortcoming of the devices known in the prior art is that no combination of an automatic pet door and elevator has been taught to assist those living in homes with elevators or apartments to have a system that allows for a pet to exit the building and return on its own.

Another shortcoming is that the devices known in the prior art are the lack of a logic controller to provide identification means and wireless control of the animal pet door and a residential elevator.

SUMMARY OF THE INVENTION

The present invention combines a residential elevator and automatic pet door with an intelligence component comprised of a Programmable Logic Controller with programmed intelligence that enables interoperability between the residential elevator and automatic pet door. In practice a pet will wear a collar with an attached or embedded transmitter. As the pet approaches the elevator door, the swing door will open and the accordion gate will open. If the elevator is at another level when the pet approaches, a call will be submitted to bring the elevator to the pet's level. The swing door and gate will open automatically when the elevator arrives. The gate and door will remain open long enough for the pet to enter the elevator and close automatically. The call to another floor will automatically be submitted to the elevator based on the current floor location.

The technology required to enable the present invention includes a Residential Elevator with automatic swing doors and automatic gate; a Transmitter collar for the pet; and multiple receivers one at each level; and a Programmable Logic Controller (PLC) with programmed intelligence to enable the pet to use the door and elevator as necessary.

It is an objective of the present invention to teach the combination of an automatic pet door and elevator to allow a pet to leave, enter, and move throughout a building.

In addition, it is the objective of the present invention to teach a logic controller to provide identification means and wireless control of the animal pet door and a residential elevator.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

Referring to the figures, it is possible to see the various major elements constituting the apparatus of the present invention. The present invention is the combination of two commercially available products, a Residential Elevator and an Automatic Pet Door, with the addition of a programmed logic controller.

Figure 1:
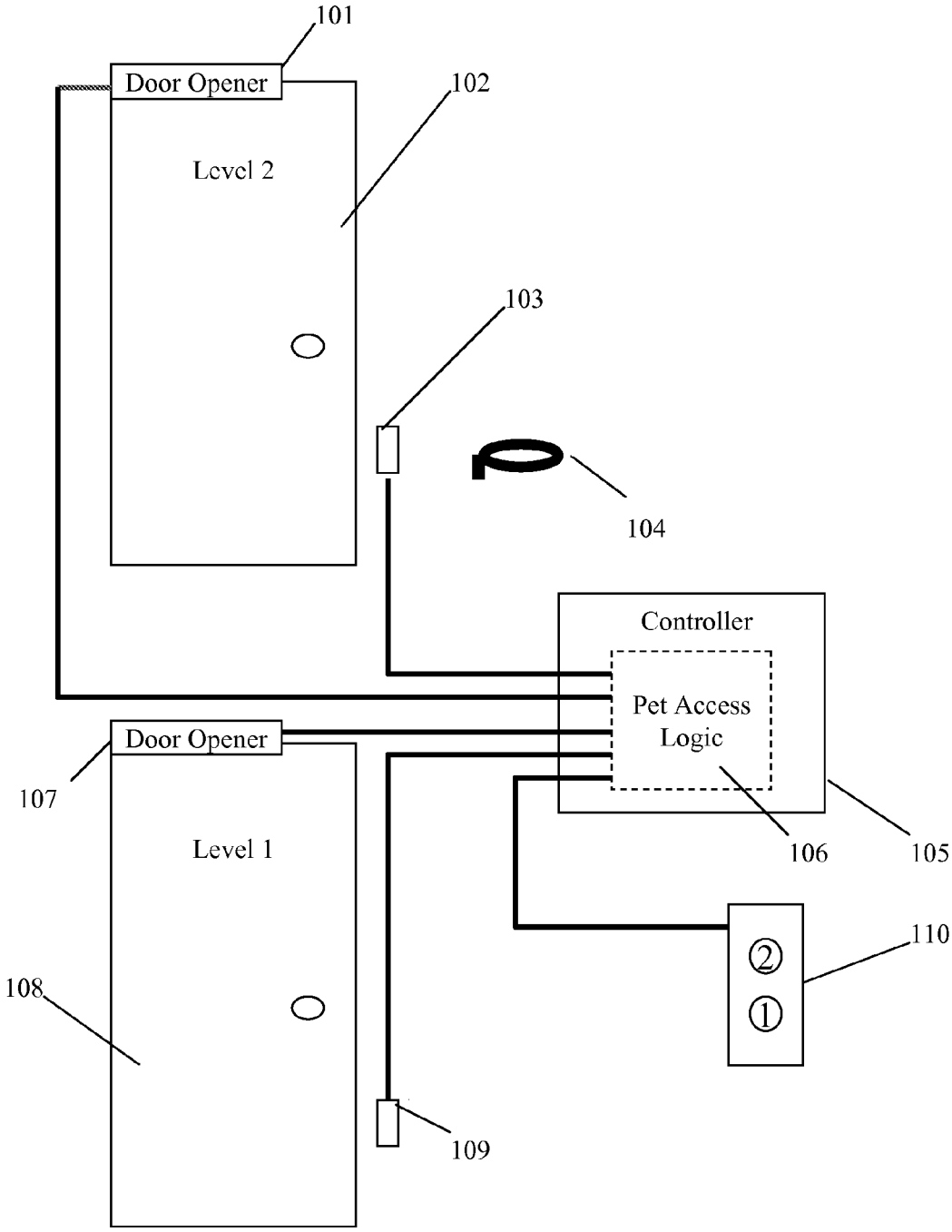
FIG. 1 is a schematic illustrating the physical embodiment and layout of the present invention.

Now referring to FIG. 1, the physical components of the Residential Elevator with Automatic Pet Door and their physical layout in one embodiment of the present invention are illustrated. Technology required to enable the present invention includes a Residential Elevator with automatic swing doors and an automatic gate; a transmitter collar 104 for the pet, and multiple receivers 103 and 109, one at each level; and a Programmable Logic Controller 105 with programmed access intelligence 106.

The present invention can be installed or incorporated into a Residential Elevator that has swing doors at each level 102 and 108 and a collapsing accordion gate on the cab. Electric motors 101 and 107 are provided for residential elevators to provide automatic opening of the swing doors and the accordion gate. Typically, the opening of the door and gate is initiated by pressing the hall call button or pressing a button on a remote control. The user enters the cab and press a button on the wall indicating the floor they wish to travel. In the present invention a pet wears a collar 104 with a transmitter. The door has a receiver 103 and 109 in it that senses when the pet approaches. As the pet approaches the door 102 and 108, the door 102 and 108 is opened automatically by a motorized mechanism 101 and 107 within the door assembly.

Safety features that may be added to the present invention include a sensor to detect if the pet and the collar 104 are located within the path of the elevator door 102 and 108. This location detection protects the pet from being harmed by a closing door 102 and 108. Detection means could be a light rail sensor or a motion sensor directed to the area of the closing door 102 and 108, or an algorithm in the Programmable Logic Controller 105 which can determine if the location of the collar 104 and its associated transmitter are within the path of the elevator door 102 and 108.

Figure 2:
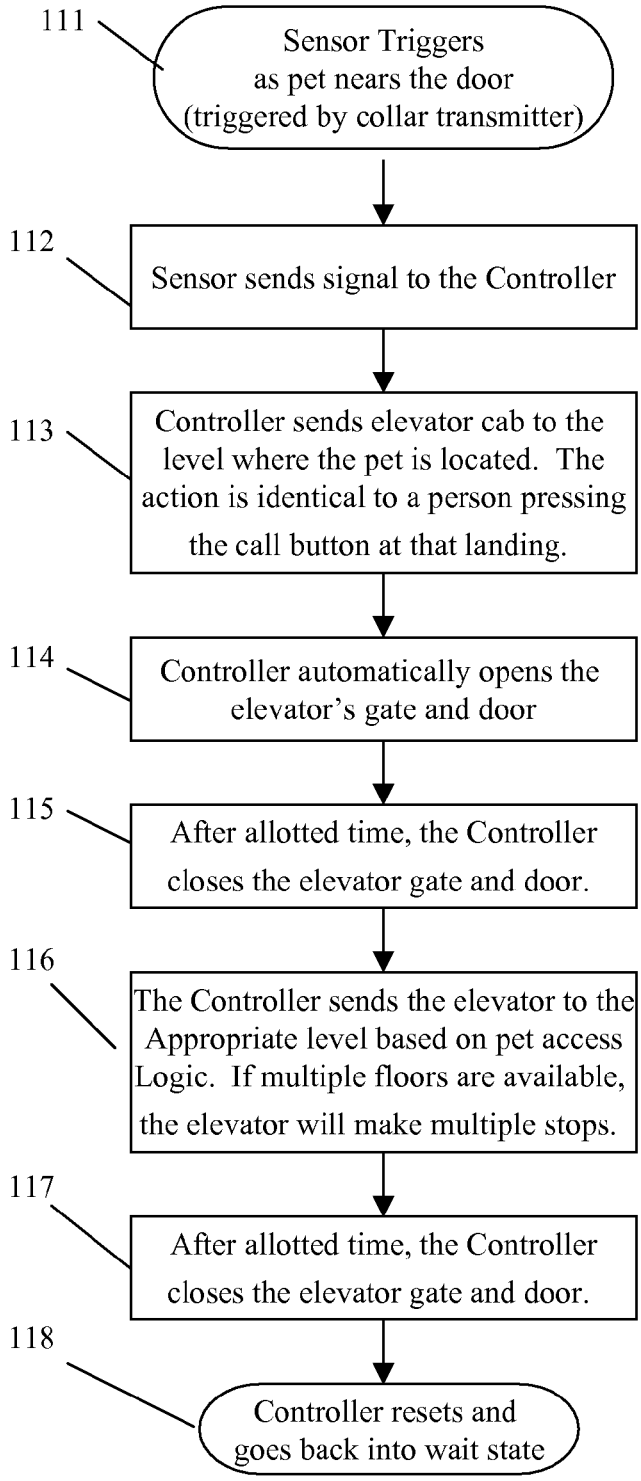
FIG. 2 is a flow chart illustrating the process steps associated with the present invention.

Now referring to FIG. 2, one example of the operating process of the present invention is illustrated. In a first step 111 a pet wearing a collar 104 with a transmitter approaches the elevator door. Upon the pets approach in a second step 112, the collar 104, equipped with a transmitter sends a signal to the controller 105. Now in a third step 113, the controller 105 determines if the elevator cab is on the same level as the collar. If the elevator is at another level when the pet approaches, a call will be submitted to bring the elevator to the pet's level. This action is identical to that of a person pressing the call button.

In a fourth step 114, the controller 105 opens the swing door and gate automatically when the elevator arrives. In a fifth step 115, the gate and door will remain open long enough for the pet to enter the elevator and close automatically. The controller has a timer setting which is adjustable for controlling the length of time the door remains open. In an alternative embodiment, an audible device signaling for the pet to enter or exit the elevator cab may also be included.

In a sixth step 116, the call to another floor will automatically be submitted to the elevator by the access logic 106 in the controller 105 based on the current floor location. If multiple floors are available, the elevator will make multiple stops and in a seventh step 117, will again the gate and door will remain open long enough for the pet to enter the elevator and close automatically.

Finally, after all stops are made, the controller 105 resets in an eight step 118 and enters a waiting state where the same or a similar sequence of actions would occur for the pets return trip. In an alternative embodiment the system should have means for detecting if the pet has exited the elevator, so the pet is not trapped in the elevator upon completion of stops.

In the event a person enters the elevator at the same time or while a pet is riding in the elevator, there would be means for the person to override the elevator operation so that the person may proceed directly to their destination.

The residential elevator with automatic pet door for detection and logic component for operation may also incorporate options to work with industry standard transmitting collars, proprietary transmitters, collars with RFIDs, implanted RFIDs, or a button for use as previously described. Additionally, the present invention should be interoperable with current residential elevators, but also all other commercial elevators, custom sized mini-elevators, dumbwaiters, and other similar or equivalent devices develop for pet transportation within a building.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The invention claimed is:

1. A device for controlling an elevator comprising:

a residential elevator traveling to one or more floors in a building, said residential elevator further comprising a traveling cab with an automatic door;

a transmitter collar;

a plurality of receivers for communicating with a programmable logic controller;

one receiver located at each floor;

a programmable logic controller;

said collar transmits a signal to the receiver;

said receiver communicates the signal to the programmable logic controller;

said programmable logic controller determines the elevator location;

said programmable logic controller opens the automatic door when the elevator arrives at the floor corresponding to the receiver receiving the signal from the collar;

said programmable logic controller further comprising programmed access intelligence means; and said programmable logic controller controls the length of time the automatic door remains open.

2. The device for controlling an elevator of claim 1 wherein said elevator is further comprised of swing doors at each floor and a collapsing accordion gate on the cab.

3. The device for controlling an elevator of claim 2 wherein electric motors are provided as means for automatically opening of the swing doors and the accordion gate.

4. The device for controlling an elevator of claim 1 further comprising sensor means for controlling and stopping a closing motion of the automatic door when the transmitter collar is detected within the door's path.

5. The device for controlling an elevator of claim 3 further comprising detection means for determining if the transmitter collar has exited the elevator cab.

6. A system for controlling an elevator wherein:

a pet wearing a collar consisting of a transmitter approaches an elevator door;

said collar transmits a signal to a controller;

said controller determines the elevator cab's floor location;

said controller opens a swing door and gate automatically when the elevator arrives;

said gate and door remain opens for the pet to enter and closes automatically;

a call to another floor is automatically submitted to the elevator by access logic in the controller based on the current floor location of the elevator; and upon arrival at a desired floor said gate and door remain opens for the pet to exit and closes automatically.

7. The system for controlling an elevator of claim 6 wherein when the elevator is at another level when the pet approaches, a call will be submitted to the controller to move the elevator to the pet's level.

8. The system for controlling an elevator of claim 6 wherein the controller has a timer setting which is adjustable for controlling the length of time the door remains open.

9. The system for controlling an elevator of claim 6 wherein when multiple floors are available, the elevator will make multiple stops where the gate and door will remain open for the pet to enter or exit the elevator and close automatically.

10. The system for controlling an elevator of claim 6 wherein after all stops are made, the controller resets and enters a waiting state.

11. The device for controlling an elevator of claim 6 further comprising sensor means for controlling and stopping the closing motion of the automatic door when the transmitter collar is detected within the door's path.

12. The device for controlling an elevator of claim 10 further comprising detection means for determining if the transmitter collar has exited the elevator cab.

13. The device for controlling an elevator of claim 6 further comprising audible signaling means indicating that a pet should enter or exit from the elevator cab.

14. The device for controlling an elevator of claim 6 wherein the elevator is a residential elevator, commercial elevator, custom sized mini-elevator, or a dumbwaiter.

15. The device for controlling an elevator of claim 6 further comprising means for a person to override the elevator operation wherein a pet is traveling with a person in the elevator.

16. The device for controlling an elevator of claim 12 wherein detection means could be a light rail sensor or a motion sensor directed to the area of the closing door.

17. The device for controlling an elevator of claim 11 wherein sensor means could be a light rail sensor or a motion sensor directed to the area of the closing door.

* * * * *